US007119304B2

(12) United States Patent
Meyers

(10) Patent No.: US 7,119,304 B2
(45) Date of Patent: Oct. 10, 2006

(54) HEATED HAND GRIP

(76) Inventor: Marcy Meyers, 24761 W. 103rd Terrace, Olathe, KS (US) 66061

( * ) Notice: Subject to any disclaimer, the term of this patent is extended or adjusted under 35 U.S.C. 154(b) by 0 days.

(21) Appl. No.: 11/007,429

(22) Filed: Dec. 8, 2004

(65) Prior Publication Data

US 2006/0043085 A1 Mar. 2, 2006

Related U.S. Application Data

(60) Provisional application No. 60/604,585, filed on Aug. 26, 2004.

(51) Int. Cl.
*H05B 1/00* (2006.01)

(52) U.S. Cl. ..... 219/204; 219/201; 219/211; 219/535; 219/528; 124/88; 124/86; 126/204; 126/208

(58) Field of Classification Search ..... 219/204, 219/201, 211, 535, 528, 527; 124/88, 86; 126/204, 208
See application file for complete search history.

(56) References Cited

U.S. PATENT DOCUMENTS 4,440,421 A * 4/1984 Adamson ..... 280/821
4,937,429 A * 6/1990 Hollander ..... 219/204

* cited by examiner

*Primary Examiner*—Shawntina Fuqua
(74) *Attorney, Agent, or Firm*—Sonnenschein Nath & Rosenthal LLP; Bryan P. Stanley

(57) ABSTRACT

A rechargeable, reusable heated hand grip for use on a ski pole, shovel or other cold weather hand-held tool or object is provided. The hand grip includes a bushing for receiving the end of a tubular object and retaining the object within a bore in the central core of the hand grip, which compresses around the bushing for tight engagement. A wire-wound heating element is wrapped around the exterior surface of the central core and an outer housing surrounds the heating element and the central core. The bore houses a pair of lithium-ion batteries connected in series, a switch with the switch control protruding from the top of the grip, and a printed circuit board connected to the switch.

24 Claims, 8 Drawing Sheets

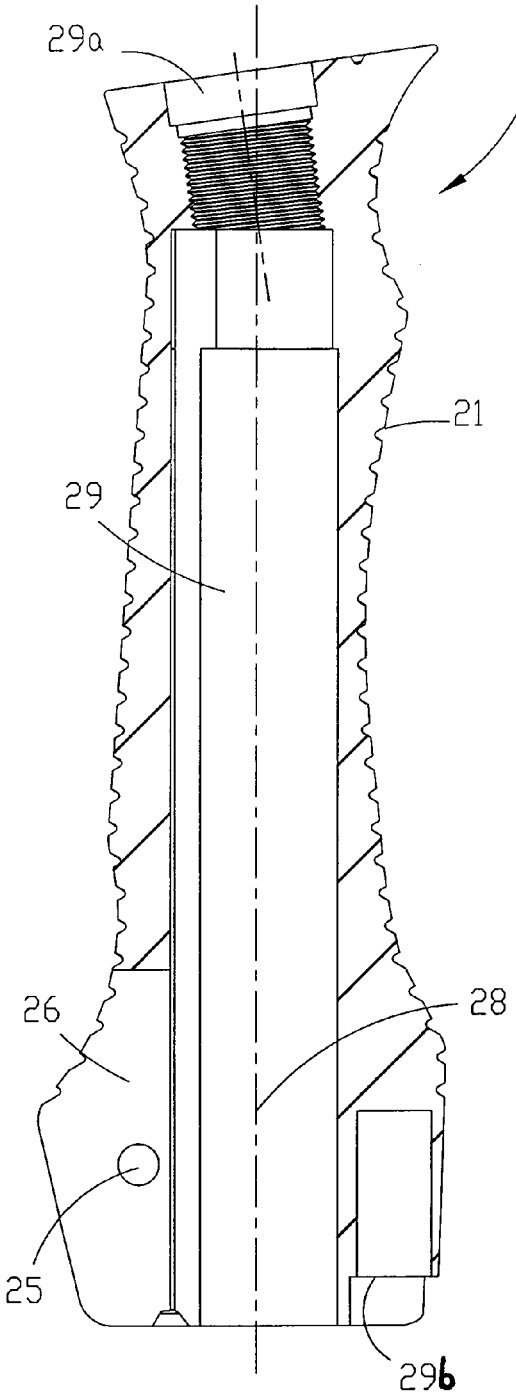
Fig. 10.
Fig. 9.
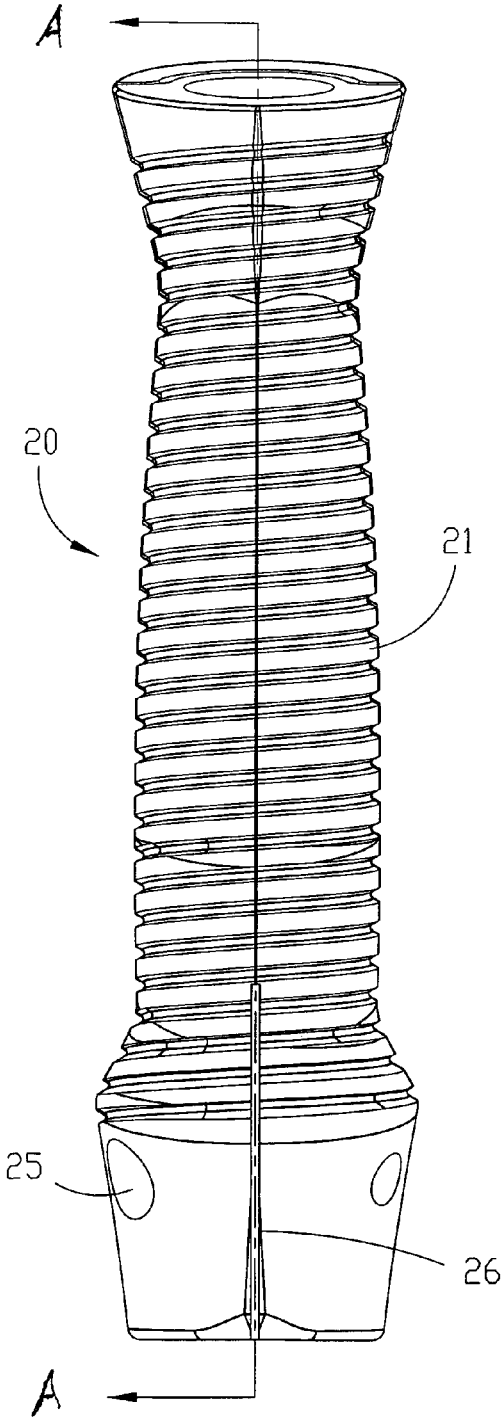

HEATED HAND GRIP

This application claims priority pursuant to 35 U.S.C. 119(e) to co-pending U.S. Provisional Patent Application Ser. No. 60/604,585, filed Aug. 26, 2004, the entire disclosure of which is incorporated herein by reference.

FIELD OF THE INVENTION

The present invention relates generally to a heated hand grip. More particularly, the present invention is concerned with a heated hand grip for use on a ski pole, shovel or other cold weather hand-held tool or object.

BACKGROUND OF THE INVENTION

Heated hand grips for cold weather hand-held objects, such as ski poles, archery bows, fishing poles and trolling motors are well known. Examples of such heated hand grips are shown in U.S. Pat. No. 4,440,421 issued to Adamson, U.S. Pat. No. 4,598,192 issued to Garrett, U.S. Pat. No. 5,585,026 issued to Smith, Jr. et al., and U.S. Pat. No. 5,934,267 issued to Briner, the entire disclosures of which are incorporated herein by reference.

The disclosures of Briner and Smith, Jr. et al. both relate to heated hand grips for archery bows. Smith, Jr. et al. discloses a heated hand grip that is form-fitted to the outer surface of the bow. The heating element of Smith, Jr. et al. is flexible planar heat tape that is attached to the surface of the bow by a hook and pile connection and connected to a battery located apart from the hand grip. Briner discloses a heated hand grip that is molded in, or otherwise form-fitted (such as a flexible heat tape or custom molded piece) around or into the bow and also connected to a battery located apart from the hand grip. The molded in hand grip of Briner must be appropriately sized and shaped during construction to fit the particular bow on which the hand grip is to be used. A form-fitted embodiment of the hand grip of Briner can be attached to a bow by an adhesive. Neither Smith, Jr. et al. or Briner disclose a hand grip that includes the power source within the grip, or which is suitable for attaching to a ski pole, shovel or similar tubular object.

Garrett discloses a heated hand grip for a fishing rod and/or trolling motor that is connected to an external power source such as a boat battery. The fishing rod of Garret is frictionally engaged with the inner surface of a cylindrical ferrule. The cylindrical ferrule is frictionally engaged with the inner surface of a bushing which is held within a cavity in the hand grip of Garrett by a set screw. The ease of assembly and disassembly (either intentional or inadvertent) of the rod from the ferrule and the ferrule from the bushing is dependant upon the coefficient of friction of the materials used for the ferrule and the bushing, as well as on the tolerances between the outer surfaces of the rod and ferrule to the inner surfaces of the ferrule and bushing, respectively. If the coefficient of friction is too low, or the tolerance between outer and inner surfaces is too high, the rod may inadvertently come apart during use. If the coefficient of friction is too high, or the tolerance between outer and inner surfaces is too low, assembly or disassembly will be more difficult.

Adamson discloses a heated hand grip for attaching to a ski pole that includes the power source within the hand grip. Although Adamson states that the hand grip can be held in place on the ski pole by a variety of methods, such as an interference fit, a mechanical locking arrangement or an adhesive, Adamson does not disclose a method for easily attaching a single hand grip to ski poles of varying sizes. Furthermore, the heating element of Adamson is either affixed to the surface of hand grip or formed integrally with the surface of the hand grip. While such an arrangement is acceptable for the hand grip of Adamson, in which the heating element is located on the interior surface of a protective shield than surrounds the portion of the hand grip that is held within the skier's hand, it is less desirable for hand grips in which the source of heat is intended to emanate from the portion of the grip being held with the skier's hand. In such instances, the location of a heating element on the surface of the grip or formed integrally with the surface of the grip will greatly limit the materials that may be utilized to provide a comfortable, cushioned grip. Therefore, it would be beneficial to provide a heated hand grip that can be easily installed onto a ski pole or other similar object that provides a comfortable, cushioned grip.

SUMMARY OF THE INVENTION

An object of the instant invention is to provide a heated hand grip that can be easily installed on a ski pole or other tubular object. Another object of the instant invention is to provide a heated hand grip that provides a comfortable, cushioned grip. Other objects of the instant invention are to provide an electrically heated hand grip that is waterproof, easy to manufacture, lightweight and reliable.

The objects of the instant invention are accomplished through the use of a heated hand grip including a central core and an outer housing. In a preferred embodiment, the outer housing comprises a one-piece pour-over. The central core includes a bore extending generally through the length of the core. The bore houses a pair of lithium-ion batteries connected in series (referred to as the "battery") for powering the heated hand grip and receives the top end of a ski pole (or other tubular object) to which the grip is attached. The top end of the ski pole is inserted within a bushing that has an outer diameter corresponding to the inner diameter of the bore and an inner diameter corresponding to the outer diameter of the pole. A switch is also housed in the bore, with the switch control (such as a push button) protruding from the top of the grip. In a preferred embodiment, the switch turns the heating element on and off and also contains an LED to indicate the operating status of the heating element (i.e. on or off). A printed circuit board (PCB) is connected to the switch and located within the bore. The PCB is connected to a conductor that engages the positive terminal of the battery. The PCB is also connected to a conductor that is adapted to electrically engage the negative terminal of the battery. A cavity is located within the central core for positioning a recharge jack. The recharge jack is electrically connected to the battery for charging.

In a preferred embodiment of the instant invention, the outer surface of the central core is generally smooth and a wire-wound heating element (including a fiberglass material backing and an electrical conductor) is wrapped around and attached to the smooth surface. In an alternative embodiment, the outer surface of the central core includes helical grooves in which a wire heating element is positioned. The heating element is connected to the PCB to be turned on and off by the control switch. The central core is manufactured of a relatively rigid material, such as high density polypropylene (HDPP). In a preferred embodiment the central core is made of a composite of HDPP which includes approximately 30% glass. The glass increases the insulating characteristics of the central core so as to minimize heat drain from the heating element to the bore of the central core and through the pole to which the grip is attached.

The one-piece pour-over outer housing forms a shell around the outer surface of the central core of the hand grip. The housing is made of a rubber, lower density polypropylene, or other material suitable to provide the amount of cushioning desired for the hand grip. The material, in a fluid state, is poured over the central core after the heating element is positioned (either over the smooth surface or in the grooves of the core), and the fluid is allowed to solidify. In the embodiment in which the heating element comprises a fiber glass backing material and attached conductor, the fluid of the housing pour-over will soak through the fiberglass backing to bond with the central core. The thicknesses of the walls of the outer housing are minimized to increase the efficiency of heat conduction from the heating element to the outer surface of the housing. At the same time enough wall thickness is provided to provide adequate cushioning for the grip when held by a user.

In a preferred embodiment, appropriate material compositions and thickness are selected to allow the outer surface of the outer housing to reach and maintain a temperature of 104° F. at an environmental temperature as low as −20° F. A temperature sensor (or temperature limiter switch) is located between the outer surface of the central core and the inner surface of the housing. The temperature sensor is connected electrically to the PCB to cause the heating element to be deenergized when the temperature exceeds the 104° F. level. In addition, the temperature sensor will cause the heating element to reenergize when the temperature drops below a minimum level, such as 95° F. It will be appreciated that two or more separate temperature switches can also be utilized to maintain the temperature in the desired operating range.

In a preferred embodiment of the instant invention, a split bushing is utilized to hold the ski pole within the bore of the central core. In addition, the lower portions of the central core and the outer housing, in which the bushing is to be located, include a lateral slit. The split bushing allows the ski pole to be easily inserted into the bushing by reducing the frictional forces exerted on the outer surface of the pole by the inner surface of the bushing as the split in the bushing allows the walls of the bushing to deform and separate from each other as the pole is inserted. Likewise, the lateral slit in the core/housing allows the walls of the core/housing to separate from each other as the bushing is inserted into the bore, allowing the bushing to be inserted with a minimal amount of effort. Once the ski pole is inserted in the bushing the bushing then is inserted in the bore of the central core (to which the outer housing has already been poured over). A screw is then inserted through the housing/core and tightened to clamp the housing/core around the bushing, which in turn clamps the bushing around the pole. This provides a tight frictional fit between all of the components such that the pole cannot be released from the hand grip without loosening the screw. In a preferred embodiment, multiple bushings having various inner diameters are provided with each hand grip to allow the hand grip to be installed on ski poles of varying common outer diameters. For example, common outer diameters for ski poles include, but are not limited to, 13 mm and 11 mm. The actual diameters for a ski pole shaft will vary slightly between manufacturers and materials used for the pole. Nevertheless, the construction of the instant invention including the split bushing, core slit and screw allows for a tight frictional engagement regardless of slight variations in pole diameters. Therefore, it is not required that the bushing of the instant invention have an inner diameter that corresponds exactly to the outer diameter of the pole. Bushings of various other inner diameters can be utilized in connection with the instant invention to permit installation on virtually any tubular object in which inclement conditions affect warmth and comfort, such as alpine poles, hiking poles, cross country poles, shovels, paddles, etc. Furthermore, it will be appreciated that the bushing can be eliminated in cases in which the inner diameter of the bore in the central core corresponds to the outer diameter of the tubular object to which the handle is being attached, and multiple size options are not desired. For example, the hand grip of the instant invention can be designed to be the handle for a snow shovel. In such an arrangement, slight modification of the hand grip discussed above will be made to retain the battery in position without the bushing.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein are set forth by way of illustration and example, embodiments of this invention and various features thereof.

BRIEF DESCRIPTION OF THE DRAWINGS

Preferred embodiments of the invention, illustrative of the best mode in which the applicant has contemplated applying the principles, are set forth in the following description and are shown in the drawings and are particularly and distinctly pointed out and set forth in the appended claims.

FIG. 9 is a rear elevation view of an alternative embodiment of a central core for a hand grip of the instant invention.

FIG. 10 is a section view of the central core of FIG. 9 taken along line A—A.

DETAILED DESCRIPTION OF A PREFERRED EMBODIMENT

As required, detailed embodiments of the present invention are disclosed herein; however, it is to be understood that the disclosed embodiments are merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
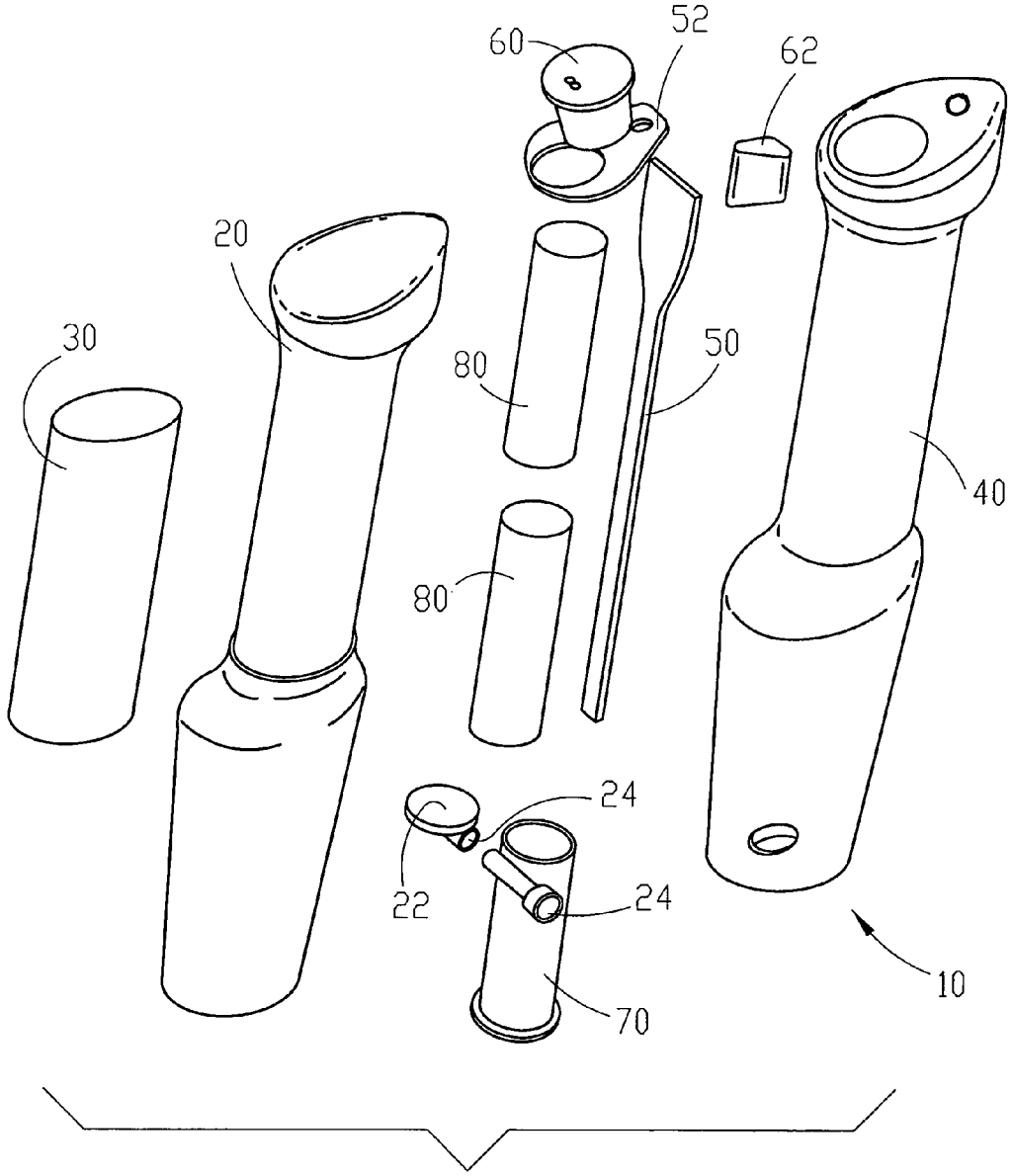
FIG. 1 is an exploded view of an embodiment of a ski pole hand grip of the instant invention.
Figure 2:
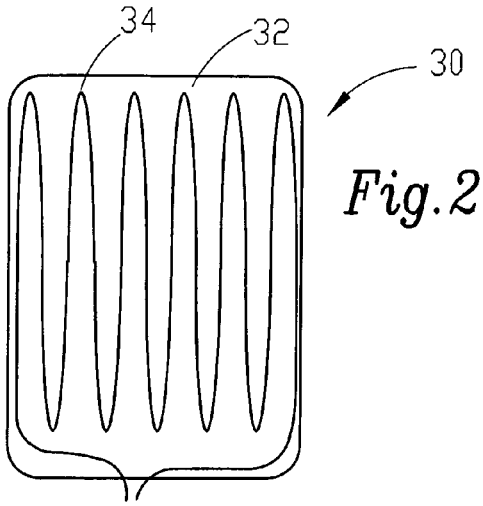
FIG. 2 is a detailed view of a heating element for the ski pole hand grip of FIG. 1.

Referring to FIGS. 1 through 8, a preferred embodiment of a heated hand grip of the instant invention for use on a ski pole is shown and described. FIG. 1 shows an exploded view of hand grip 10 which includes central core 20, set-screw assembly 24, battery core pad 22, heating element 30, outer housing 40, printed circuit boards 50 and 52, push button control switch 60, DC charger jack 62, bushing 70, and two (2) batteries 80. In the embodiment of hand grip 10 shown in FIGS. 1 through 8, heating element 30 (shown in detail in FIG. 2) is a flexible heat wrap including twisted wire 34 mounted on fiberglass backing 32, which adheres to the generally smooth outer surface of central core 20. The ends of wire 34 connect to connection pads on circuit board 52.

Figure 4:
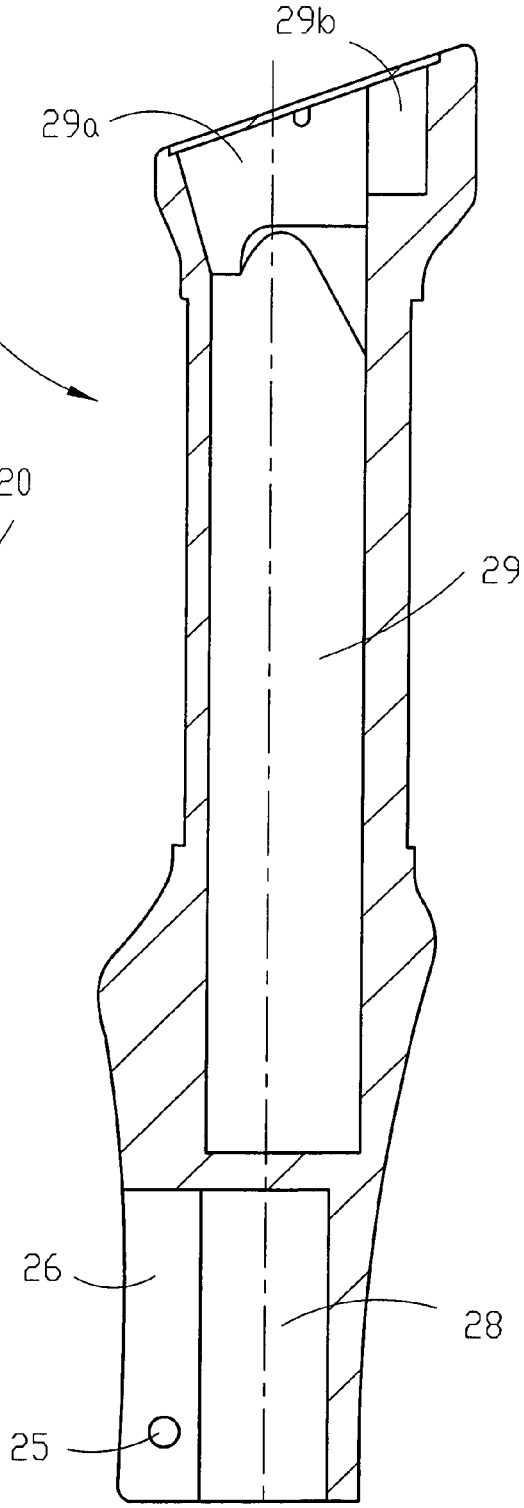
FIG. 4 is a section view of the central core of FIG. 3 taken along line A—A.
Figure 5:
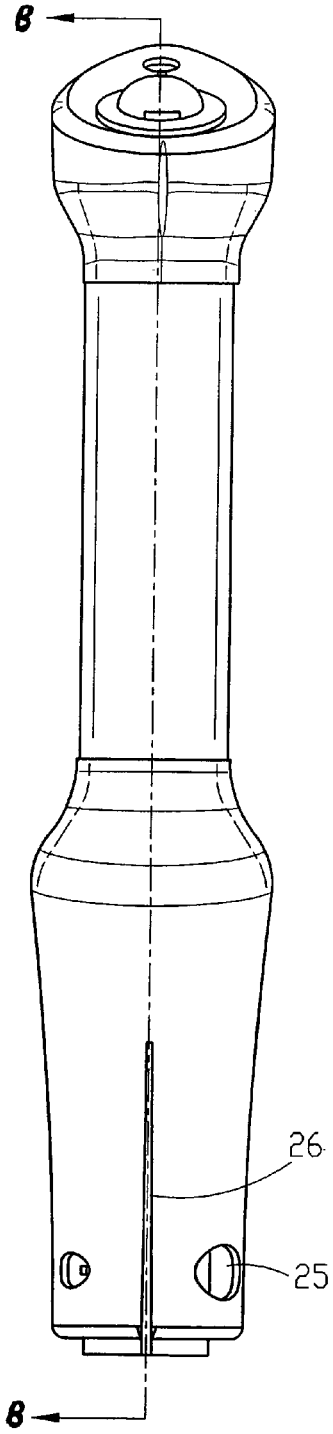
FIG. 5 is a rear elevation view of the hand grip of FIG. 1 fully assembled.
Figure 6:
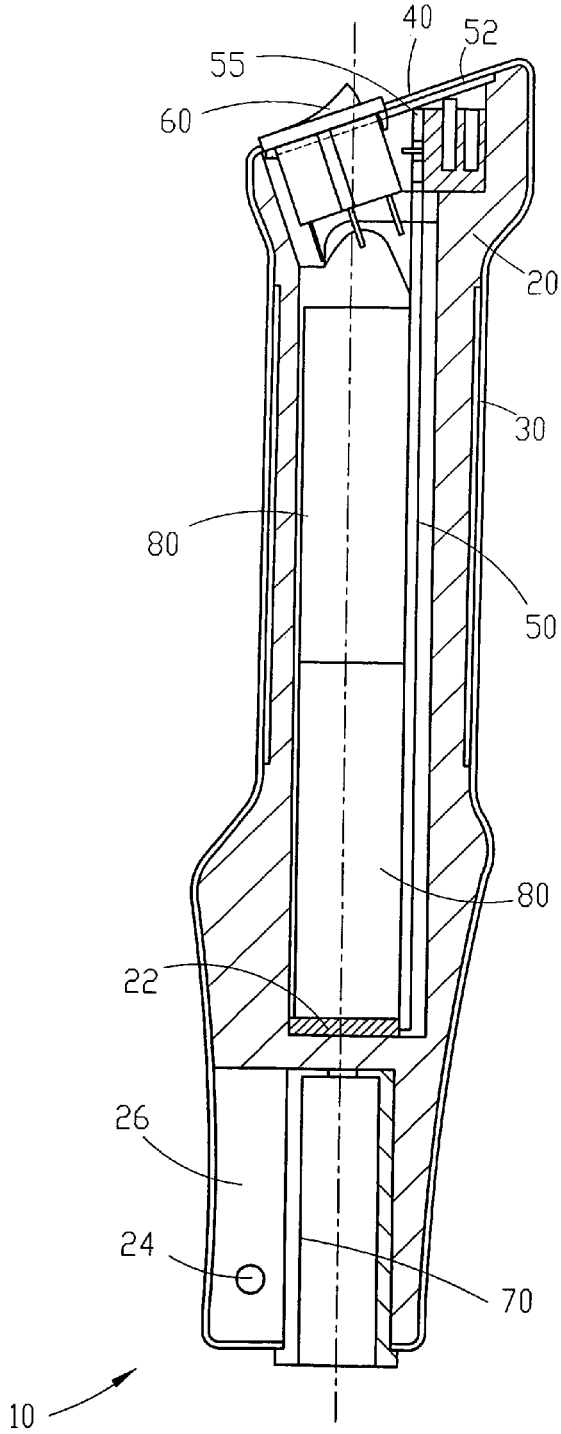
FIG. 6 is a section view of the fully assembled hand grip of FIG. 5 taken along line B—B.
Figure 8:
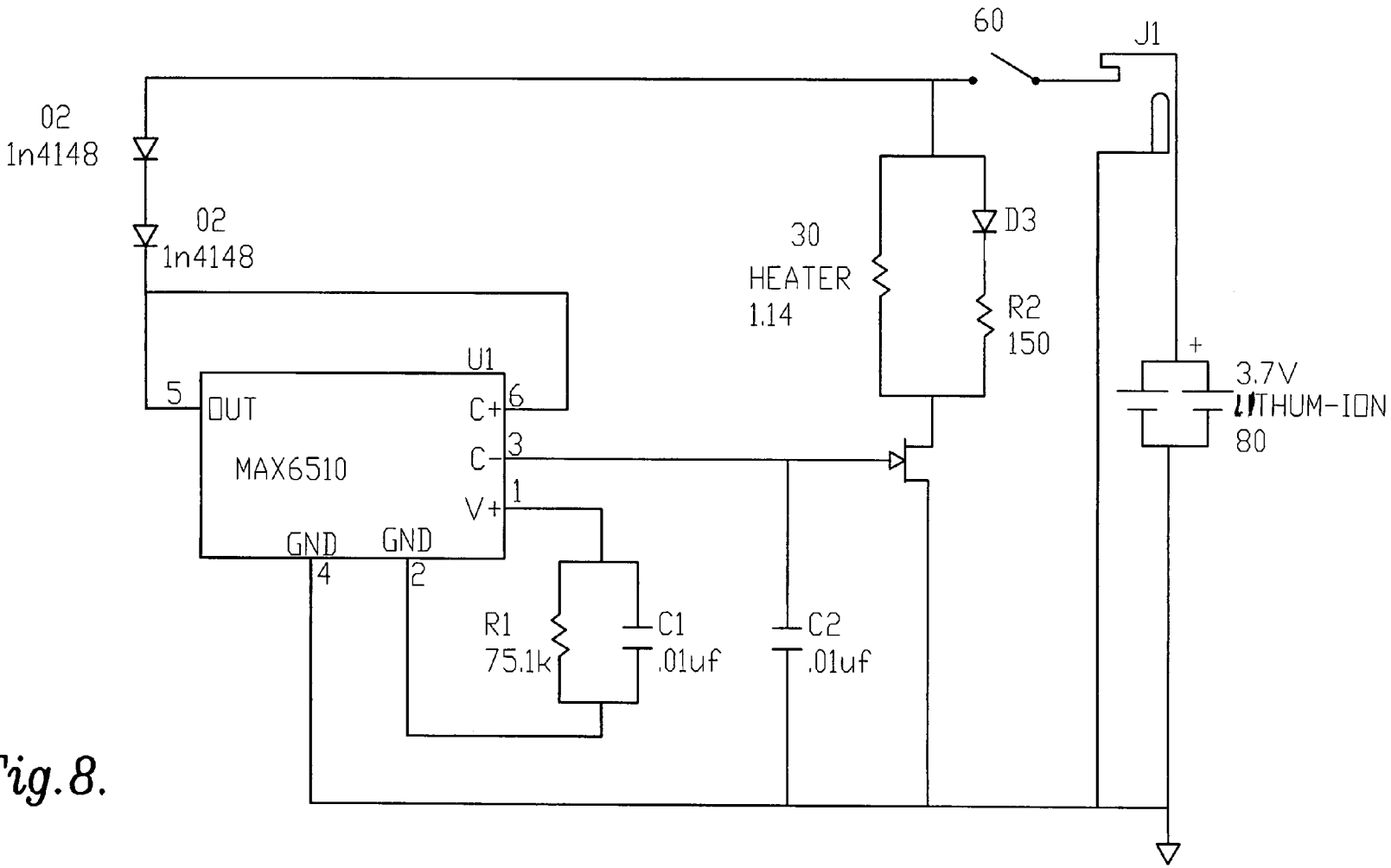
FIG. 8 is a schematic circuit diagram illustrating the interconnection between electrical components of the hand grip of FIG. 1.
Figures 11, 12:
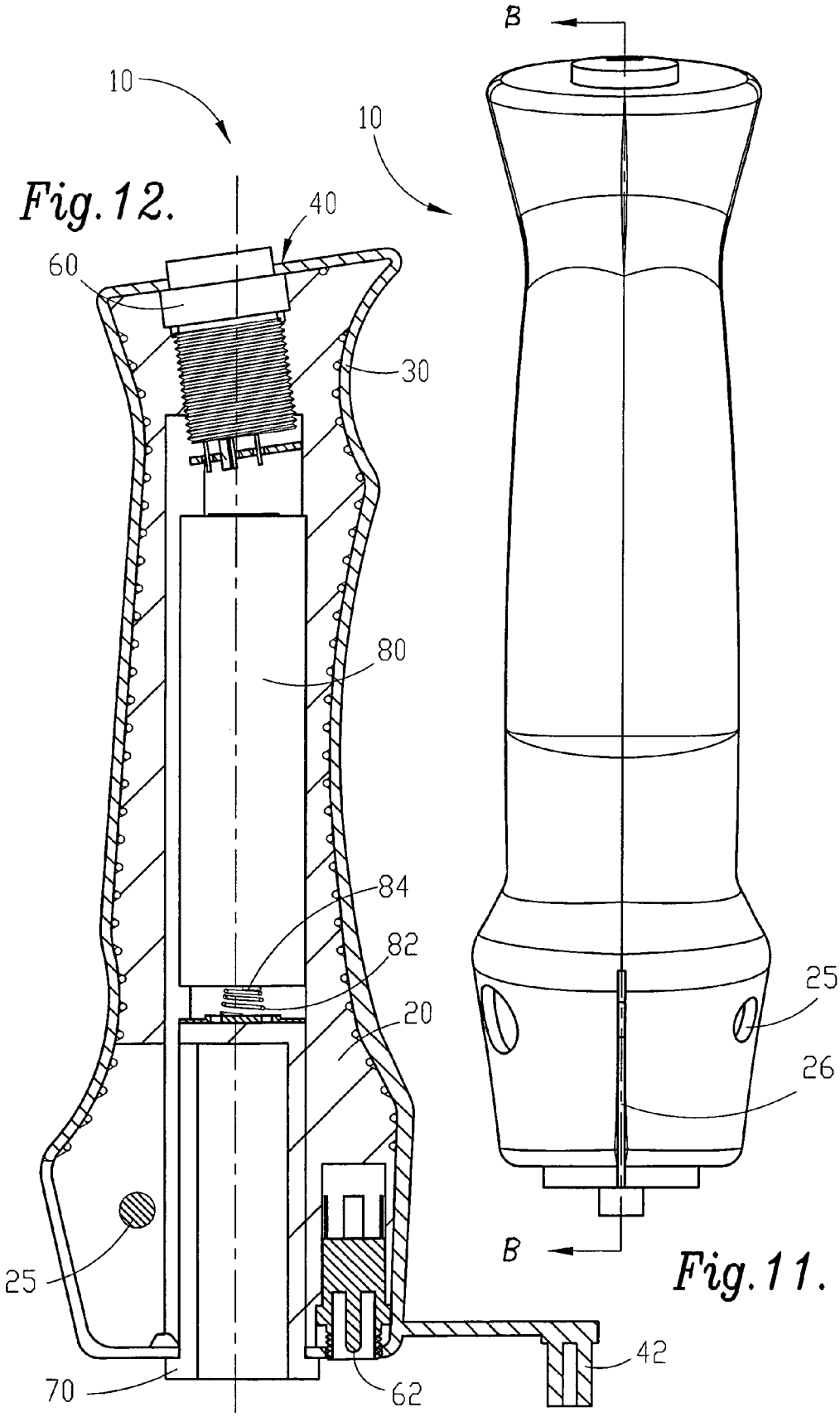
FIG. 11 is a rear elevation view of a fully assembled hand grip including the central core of FIGS. 9 and 10.
FIG. 12 is a section view of the fully assembled hand grip taken along line B—B of FIG. 11.

The preferred embodiment of rechargeable heated ski pole grip 10 of FIGS. 1 through 8 is designed to reach a constant temperature of 104 F at the exterior surface of outer housing 40 within 60 seconds of activation by depressing control switch 60 with a maximum wattage output of 15 watts and maximum temperature of 110 F. The two batteries 80 of grip 10 of the preferred embodiment are each 3.6V 2100 mAh lithium ion batteries connected together in series to achieve 7.2V. Batteries 80 are connected to heating element 30, which is a 7 watt flexible heat wrap of twisted wire 34 on fiberglass backing 32. Batteries 80 are attached directly to printed circuit board 50 which is connected to control switch 60, recharge jack 62, and a thermostat/temperature sensor (not shown), to control the supply of power from batteries 80 to heating element 30. The assembled circuit board 50, including batteries 80 slides into battery chamber 29 of central core 20 through opening 29*a* such that batteries 80 sit on top of battery core pad 22. Recharge jack 62 and switch 60 with an integrated LED are electrically and mechanically attached to top board 52 and then positioned in openings 29*a* and 29*b* of central core 20 as shown in FIG. 6 and attached to circuit board 50 via wires between boards 50 and 52. Board 52 is held securely within central core 20 by screws 55. Any void space remaining within cavity 29 after batteries 80, boards 50 and 52, switch 60 and recharge jack 62 have been installed in central core 20 is filled with an electronic gel for shock absorption and waterproofing. Central core 20 of the preferred embodiment is made of HDPP glass-reinforced for strength and durability. The assembled central core (including all components described above) receives a pour-over of rubberized polypropylene to provide grip, insulation, wire protection and further waterproofing. The hand grip attaches to most ski pole sizes by the use of bushings 70 sized to the common pole diameters. The bushing 70 fits onto the top of the pole and then inserts into the bottom of the grip. The grip tightens on the pole by set screw 24 built into bore 25 through central core 20.

Figure 13:
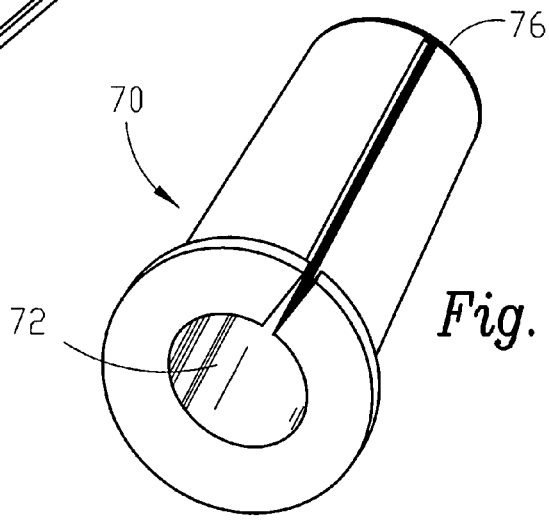
FIG. 13 is a perspective view of a split bushing of the hand grip embodiments of the instant invention shown in FIGS. 1 through 12.
Figure 3:
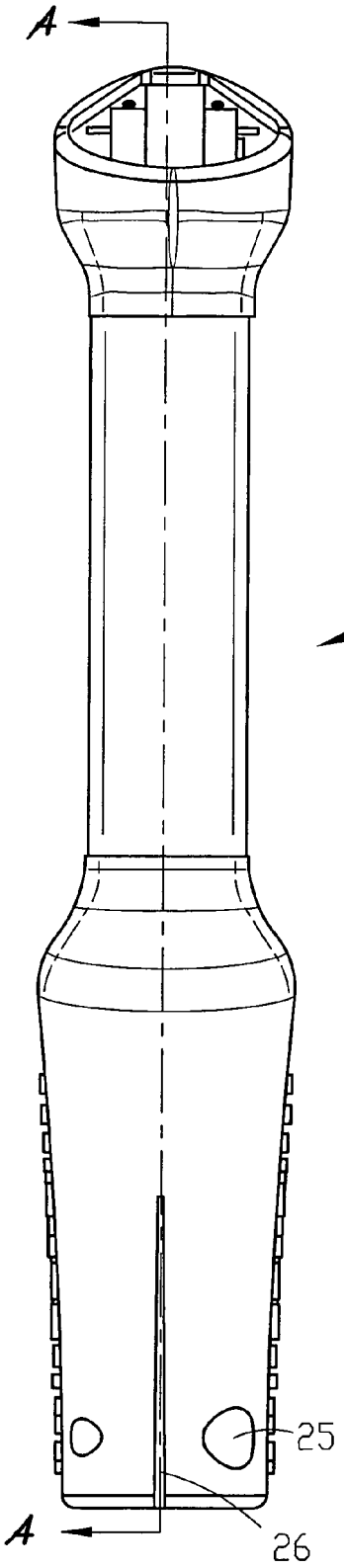
FIG. 3 is a rear elevation view of a central core for the ski pole hand grip of FIG. 1.

As is shown in FIGS. 3 and 4, central core 20 includes lateral slit 26 extending into cavity 28. As is shown in FIGS. 5 and 6, slit 26 remains after outer housing 40 has been poured over central core 70. Bushing 70 is positioned within cavity 28 of central core 20 and set screw assembly 24 is inserted into bore 25 which extends through central core 20 and slit 26 in a direction generally perpendicular to slit 26. As set screw assembly 24 is tightened, slit 26 is compressed reducing the diameter of cavity 28 and thereby compressing bushing 70. As is shown in FIG. 13, bushing 70 includes internal cavity 72 and slit 76. Although shown as partially enclosed at the top of bushing 70, it will be appreciated that internal cavity 72 of bushing 70 may extend through bushing 70 creating a bore through bushing 70. An end of a ski pole is inserted into cavity 72 of bushing 70 and bushing 70 is deformed by compressing slit 76 due to the compressive force resulting from the compression of central core 20.

Figure 7:
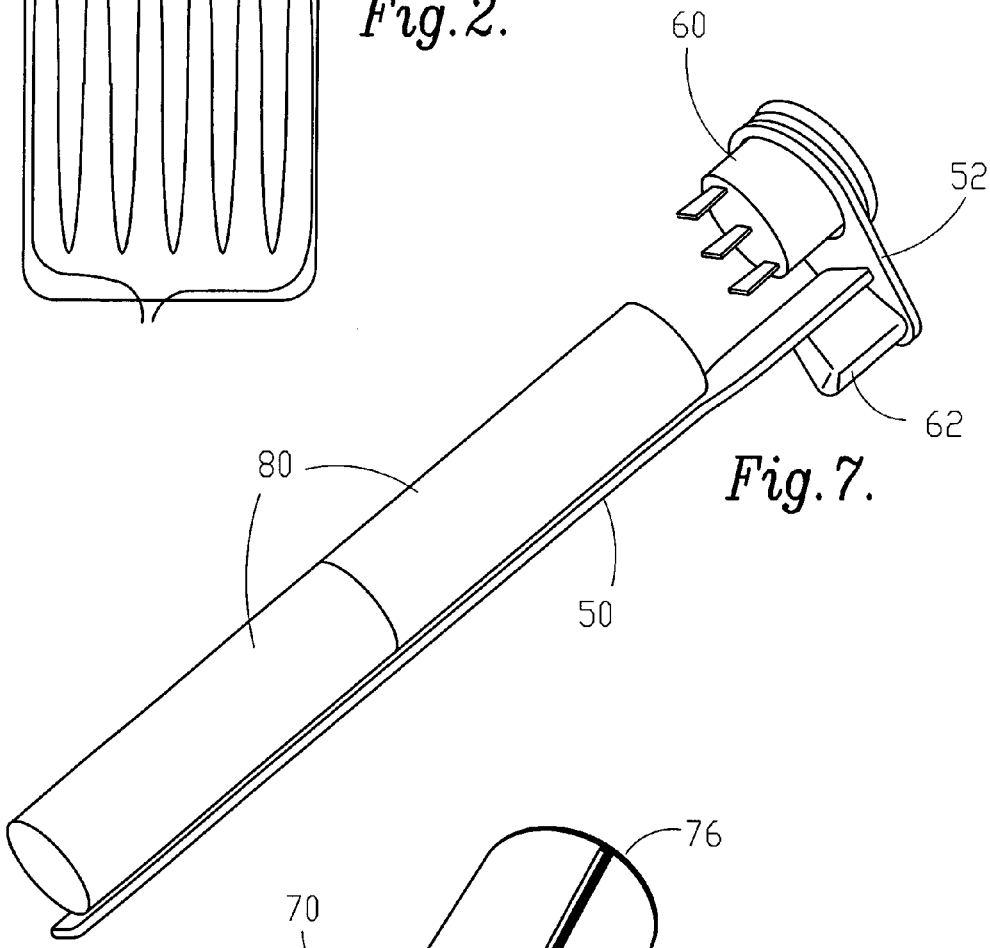
FIG. 7 is a perspective view of the components positioned within the central core of the hand grip of FIG. 1.

Referring to FIG. 7, batteries 80 are mounted to a lower portion of circuit board 50 which has a narrow diameter to fit within cavity 29 of central core 20. The top portion of circuit board 50 includes a wider diameter to fit snugly within the wider opening (29*a* and 29*b*) of cavity 29 and to provide space for electrical components (resistors, capacitors, etc.) and mounting pads for the thermostat, recharge jack, control switch, etc. Circuit board 50 is connected to circuit board 52 via wires and recharge jack 62 and switch 60 are physically mounted and electrically connected to board 52. Although the preferred embodiment of grip 10 shown in FIGS. 1 through 8 includes two printed circuit boards, 50 and 52, it will be appreciated that a single circuit board can be utilized, wherein either circuit board 50 or 52 are eliminated, or wherein either of boards 50 or 52 act merely as support structure for the components of grip 10 without providing any electrical communication between the components.

Referring to FIGS. 9 through 12, an alternative embodiment of a ski pole hand grip 10 of the instant invention is shown. Hand grip 10 shown in FIGS. 9 through 12 includes the same basic components and is manufactured in the same or similar manner as described above with reference to FIGS. 1–8. The primary difference between the embodiment of hand grip 10 shown in FIGS. 9 through 12 with that shown in FIGS. 1 through 8 is the inclusion of helical grooves 21 on the outer surface of central core 20. In the embodiment shown in FIGS. 9 through 12, heating element 30 is a wire conductor that is located in helical grooves 21.

The component arrangement of hand grip 10 of the embodiment of FIGS. 9 through 12 is slightly different than that of the embodiment of FIGS. 1–8. Nevertheless, it will be appreciated that the specific arrangement of components may be modified, such that the component arrangement shown in FIGS. 1 through 8 is utilized in connection with the helical grooves 21, such that the component arrangement of FIGS. 9 through 12 is utilized with the fiberglass backing of FIG. 2 (and smooth surface central) core, or such that an altogether different component arrangement is used, without departing from the spirit and scope of the instant invention.

In the embodiment of FIGS. 9 through 12, hand grip 10 includes a bore extending through the entire length of central core 20, that includes both cavity 28 for bushing 70 and cavity 29 for the circuit boards and other components. Alternatively, the embodiment shown in FIGS. 1 through 8 includes two separate cavities, creating a layer of insulation between cavity 29 in which batteries 80 and other electrical components are located, and cavity 28 which may be exposed to the environment. In the embodiment of hand grip 10 shown in FIGS. 9 through 12, the negative conductor of one of batteries 80 is electrically engaged with the top 82 of bushing 70 which includes spring 84 attached to top 82. Spring 84 engages the negative terminal of the battery so that bushing 70 and spring 84 hold the battery in its proper position within cavity 29 of central core 20. In addition, cavity 29*b* for housing recharge jack 62 is located separate and apart from cavities 29 and 28 at the bottom of hand grip 10. Recharge jack 62 includes rubber jack cover 42 for protecting recharge jack 62 from environmental elements during use.

Figure 15:
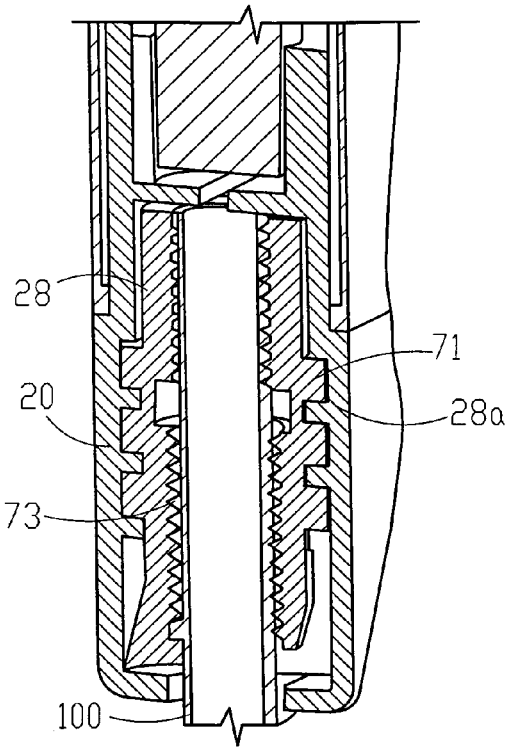
FIG. 15 is a partial section view of the hand grip of FIG. 14, showing the bushing of FIG. 14 in greater detail.
Figure 14:
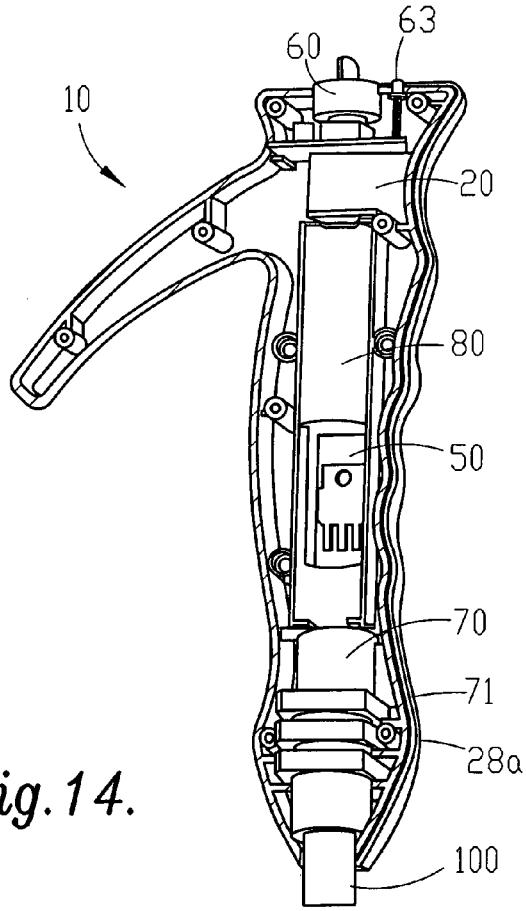
FIG. 14 is a section view of another alternative embodiment of a hand grip of the instant invention.

FIGS. 14 and 15 show another alternative embodiment of a hand grip 10 for a ski pole. In addition to several minor variations in the structural arrangement of various components of hand grip 10 from the two embodiments discussed above, the embodiment of FIGS. 14 and 15 shows an alternative embodiment of bushing 70 used to hold the pole 100 to grip 10. In addition, grip 10 of FIGS. 14 and 15 includes a two-piece central core 20 that is screwed together around bushing 70. Bushing 70 of this embodiment includes protruding ridges 71 that engage with grooves 28 within central core 20. The inner diameter of bushing 70 includes a helical thread 73 protruding inward from the inner surface of bushing 70 to engage the outer surface of pole 100. Bushing 70, including thread 73, is made of a semi-flexible material (such as HDPP) so as to allow helical thread 73 to slightly deform and frictionally engage pole 100 when it is inserted into bushing 70. The two piece central core 20, constructed of HDPP, is placed around bushing 70 and screwed together to hold the bushing within the housing. It will be appreciated that among other alternatives, the two-piece central core 20 shown in FIGS. 14 and 15 can be used in connection with the bushing 70 discussed above with respect to other embodiments of the invention, or alternatively, the bushing 70 shown in FIGS. 14 and 15 can be used in connection with the core and pour-over housing discussed above.

It will be appreciated that a variety of different control switches 60 can be utilized without departing from the spirit and scope of the instant invention. Furthermore, it will be appreciated that numerous types of rechargeable batteries can be utilized without departing from the spirit and scope of the instant invention. For example, the battery can be Lithium ion, Nickel Metal Hydride (NiMH), or any other suitable type that provides adequate mA while at the same time meeting desired size and weight specifications to fit within the hand grip and to be carried by a user without undue burden.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to exemplary embodiments, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A heated hand grip comprising:

a central core including an internal cavity and an outer surface;

a heating element associated with said central core; and an at least partially deformable bushing including an outer surface capable of insertion within said internal cavity and including an internal cavity.

2. The heated hand grip as claimed in claim 1 wherein a least a portion of said internal cavity of said central core is compressible.

3. The heated hand grip as claimed in claim 2 wherein said central core includes a lateral slit associated with said compressible portion of said internal cavity.

4. The heated hand grip as claimed in claim 3 further comprising a screw assembly extending through said central core in a direction generally perpendicular to said lateral slit.

5. The heated hand grip as claimed in claim 1 wherein said central core comprises two half sections.

6. The heated hand grip as claimed in claim 1 wherein said bushing comprises a split bushing.

7. The heated hand grip as claimed in claim 1 wherein said bushing comprises a ridge protruding from said outer surface of said bushing to engage with a groove within said internal cavity of said central core.

8. The heated hand grip as claimed in claim 1 wherein said internal cavity of said bushing comprises an inwardly protruding helical thread.

9. The heated hand grip as claimed in claim 8 wherein said helical thread is deformable.

10. The heated hand grip as claimed in claim 1 further comprising a pour-over housing for said heating element and said central core.

11. The heated hand grip as claimed in claim 1 wherein said outer surface of said central core is generally smooth and said heating element comprises an electrical conductor associated with a fiberglass backing.

12. The heated hand grip as claimed in claim 1 wherein said outer surface of said central core includes a helical groove in which said heating element is positioned.

13. A heated hand grip comprising:

a central core including an outer surface;

a heating element positioned around said outer surface of said central core; and a power source; and a printed circuit board located within said central core and electrically connected to said heating element and said power source.

14. The heated hand grip as claimed in claim 13 further comprising a temperature sensor associated with said outer surface of said central core and electrically connected to said printed circuit board.

15. The heated hand grip as claimed in claim 14 wherein said temperature sensor includes a maximum temperature threshold in which said heating element is deenergized and a minimum temperature threshold in which said heating element is energized.

16. The heated hand grip as claimed in claim 13 further comprising a control switch electrically connected to said printed circuit board.

17. The heated hand grip as claimed in claim 13 wherein said power source comprises a battery.

18. The heated hand grip as claimed in claim 13 further comprising an at least partially deformable bushing including an outer surface capable of insertion within an internal cavity of said central core and including an internal cavity.

19. The heated hand grip as claimed in claim 17 wherein said battery is rechargeable.

20. The heated hand grip as claimed in claim 19 further comprising a recharging jack electrically connected to said printed circuit board.

21. The heated hand grip as claimed in claim 20 wherein said recharging jack is mechanically connected to said printed circuit board.

22. The heated hand grip as claimed in claim 13 wherein said printed circuit board comprises multiple boards connected together.

23. A heated hand grip comprising:

a heating element positioned around an outer surface of the hand grip;

a power source;

a power control connected to said power source;

a temperature sensor associated with said power control; and a printed circuit board electrically connected to said heating element, said power source and said power control.

24. The heated hand grip as claimed in claim 23 wherein said power control and said temperature sensor are incorporated into a temperature limiter switch.

* * * * *